United States Patent [19]

Jean-Jacques et al.

[11] Patent Number: 4,965,971

[45] Date of Patent: Oct. 30, 1990

[54] ROOF MOUNTING

[75] Inventors: Leonard Jean-Jacques, P.O. Box 552, Rivonia, Transvaal, South Africa, 2128; John N. Sutherland, Edenvale, South Africa

[73] Assignee: Leonard Jean-Jacques, Sandton, South Africa

[21] Appl. No.: 103,198

[22] Filed: Oct. 1, 1987

[30] Foreign Application Priority Data

Oct. 2, 1986 [ZA] South Africa ..... 86/7532
Jun. 18, 1987 [ZA] South Africa ..... 87/4392

[51] Int. Cl.[5] ..... E04D 13/14

[52] U.S. Cl. ..... 52/199; 52/95; 52/219; 98/122; 285/44

[58] Field of Search ..... 52/199, 95, 219; 248/42, 56, 57; 98/122, 43; 285/42, 44, 43

[56] References Cited

U.S. PATENT DOCUMENTS

| | | | |
|---|---|---|---|
| 807,795 | 12/1905 | Watson | 285/44 |
| 1,332,224 | 3/1920 | McHale | 285/44 |
| 1,703,670 | 2/1929 | Hoeft | 285/44 |
| 1,704,942 | 3/1929 | Hopson | 285/44 |
| 1,762,896 | 6/1930 | Sherlock | 285/44 |
| 3,469,518 | 9/1969 | Howard | 285/44 X |
| 3,809,350 | 5/1974 | Lane | 52/219 X |
| 3,874,138 | 4/1975 | Storch | 52/219 X |
| 4,010,578 | 3/1977 | Logsdon | 285/44 X |
| 4,563,847 | 1/1986 | Hasty | 52/199 X |
| 4,570,943 | 2/1986 | Houseman et al. | 285/43 X |

FOREIGN PATENT DOCUMENTS

| | | | |
|---|---|---|---|
| 247120 | 5/1963 | Australia | 52/219 |
| 2535255 | 2/1977 | Fed. Rep. of Germany | 52/219 |

*Primary Examiner*—David A. Scherbel
*Assistant Examiner*—Jerrold D. Johnson
*Attorney, Agent, or Firm*—Cushman, Darby and Cushman

[57] ABSTRACT

A roof mounting 1 for use in giving a rise pipe 2 access through a roof 3 comprising a plate 4, 22 having a circular hole 5 therein, a connector 6 embodying a spherical formation 7 which fits closely in the circular hole in the plate, the connector having a passage therethrough and being shaped to receive the rise pipe, and, mounting means 9, 16 for mounting the connector to the plate in a manner permitting the connector to be pivotted relative to the plate, the roof mounting in an operative position being located with the plate parallel to the pitch of the roof and with the connector aligned with the rise pipe.

10 Claims, 8 Drawing Sheets

34
11
26
2
27
16
36
2

42
43
44
41
6
45

11
26
34
26
39a
39
35
31
2
40

ROOF MOUNTING

FIELD OF THE INVENTION

This invention relates to a roof mounting for giving a rise pipe access through a roof, especially a pitched roof.

BACKGROUND TO THE INVENTION

Pipe flashing is usually used to seal rise pipes and the like passing through a pitched roof. One kind of pipe flashing is manufactured in situ from galvanized steel sheeting. It consists of a base plate which is positioned on the roof parallel to the pitch of the roof and which has a hole through which the pipe passes. A cone or cowl is provided which extends from the base plate and surrounds the pipe. The cone or cowl has to be cemented or soldered to both the base plate and the pipe. This is a relatively difficult and time consuming task. Because of the widely differing roof pitches encountered in practice, it is also relatively difficult to provide an accurately dimensioned blank from which to form the cone or cowl. Thus, a pipe flashing of this kind not only presents problems in its installation but is often ineffective to prevent water leakage down the pipe. One way of overcoming these problems is described in German Auslegeschrift No. 25 35 255 (Klöber). An undertile is provided with a dome thereon. A pipe fits through the dome and has a cowl matching the shape of the dome overlying it, thereby enabling the angular position of the pipe relative to the undertile to be adjusted. This arrangement is relatively complicated and hence expensive to manufacture. It also suffers from the disadvantage that the rise pipe must be aligned exactly with the pipe passing through the undertile in order to connect to it, alternatively, an additional flexible coupling must be provided.

It is accordingly an object of the invention to provide a roof mounting with which the abovementioned disadvantages are sought to be overcome.

SUMMARY OF THE INVENTION

According to the invention a roof mounting for use in giving a rise pipe access through a roof comprises a plate having a circular hole therein, a connector embodying a spherical formation which fits closely in the circular hole in the plate, the connector having a passage therethrough and being shaped to receive the rise pipe, and, mounting means for mounting the connector to the plate in a manner permitting the connector to be pivotted relative to a plate, the roof mounting in an operative position being located with the plate parallel to the pitch of the roof and with the connector aligned with the rise pipe.

The mounting means may comprise a pair of pivots carried on the plate and projecting in the plane of the plate into the circular hole, the connector being provided in two halves split across the middle of the spherical formation, the two halves of the connector having notches for accommodating the pivots and being secured together with the pivots located in the notches. Alternatively, the pivot means may comprise a pair of trunnions carried on the spherical formation and located for rotation in a pair of bearings mounted on the underside of the plate. The bearings may be received in guide channels formed in the plate.

The roof mounting may include sealing means for sealing the connection between the spherical formation and the plate.

The sealing means may comprise a bonding agent applied to the connection. Alternatively, the sealing means may comprise a collar adapted to be secured to the plate to surround the circular hole and a sealing member located between the collar and the plate. In another form, the sealing means may comprise a ring-like retaining member adapted to be connected to the plate and a resilient sealing member adapted to be held by the retaining member in sealing engagement at the connection between the spherical formation and the plate, the arrangement being such that the retaining member may be twisted about its axis to force it towards the plate, thereby to compress the resilient sealing member. The retaining member may be trapped beneath formations on the plate and the peripheral edge of the retaining member may be sloped so that when it is twisted in one direction the edge acts on the formations to displace the retaining member towards the plate. In a further form, the sealing means may comprise a base ring secured to the plate, a resilient sealing ring located between the base ring and the plate and a sealing member bonded to the base ring.

The connector of the roof mounting may include a pair of stub pipes integral with the spherical formation and extending upwardly and downwardly from opposite ends thereof.

BRIEF DESCRIPTION OF THE DRAWINGS

Preferred embodiments of the invention will now be described with reference to the accompanying drawings in which.

DESCRIPTION OF PREFERRED EMBODIMENTS

Figure 1B:
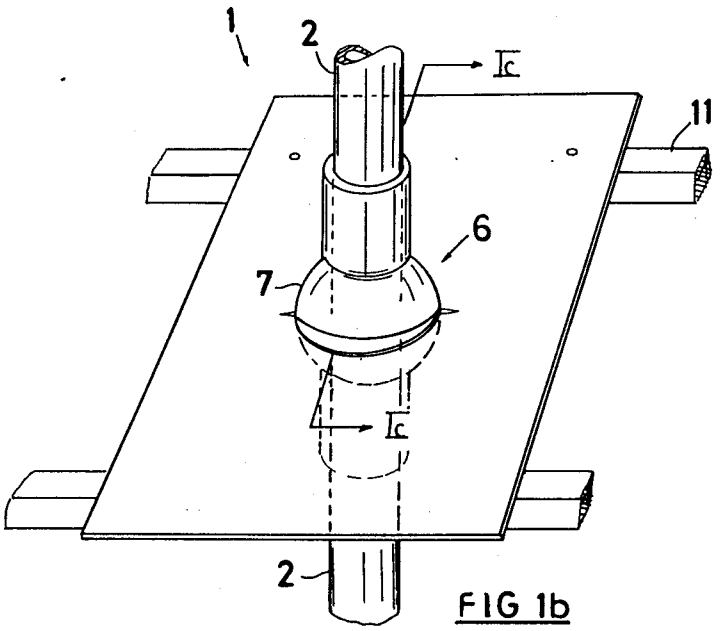
FIG. 1*b* is a perspective view of the roof mounting of FIG. 1*a* in assembled form seen from above.

In the drawings like parts are indicated by like reference numerals.

With reference to FIGS. 1*a*–1*d* a roof mounting 1 is intended to seal a rise pipe 2 passing vertically through a tiled pitched roof 3.

The roof mounting 1 comprises a flat plate 4 having a circular hole 5 located centrally therein and a connector 6 embodying a spherical formation 7 which fits closely in the hole 5. The connector 6 is hollow and has a pair of stub pipes 8 integral with the spherical formation 7 and extending upwardly and downwardly from opposite sides thereof.

Figure 1A:
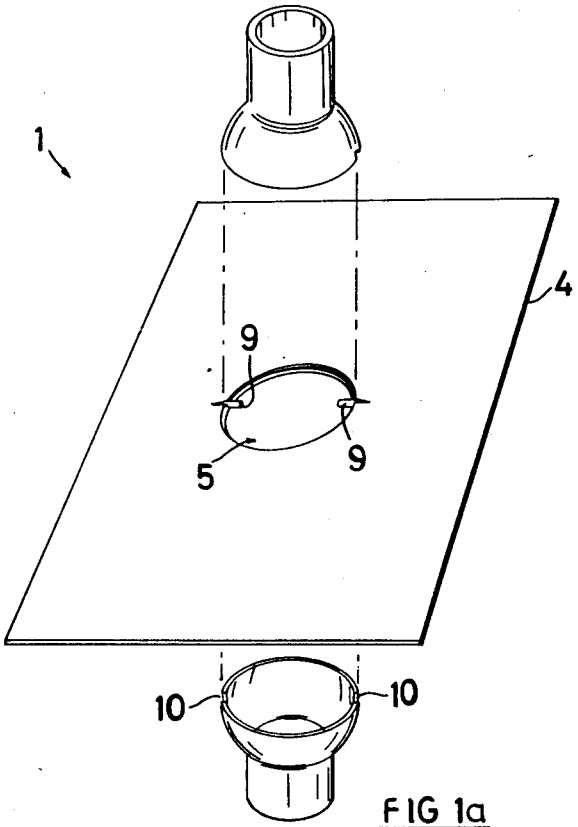
FIG. 1*a* is an exploded perspective view of a roof mounting according to the invention.

In this embodiment of the invention the connector 6 is provided in two halves split across the middle of the spherical formation 7. Means for mounting the connector 6 to the plate 4 are provided in the form of a pair of pivots 9 formed integrally with the plate and projecting in the plane of the plate into the hole 5 (FIG. 1*a*). Each of the two halves of the connector 6 is provided with a pair of diametrically opposed notches 10 for accommodating the pivots 9. In order to mount the connector 6 to the plate 4, the two connector halves are brought together from opposite sides of the plate 4 with the pivots 9 located in the notches 10. In this position the two halves are fixed together, for example, with a bonding agent or by means of ultrasonic welding. Once mounted to the plate 4 the connector 6 can pivot relative to the plate about the pivots 9.

Figure 1C:
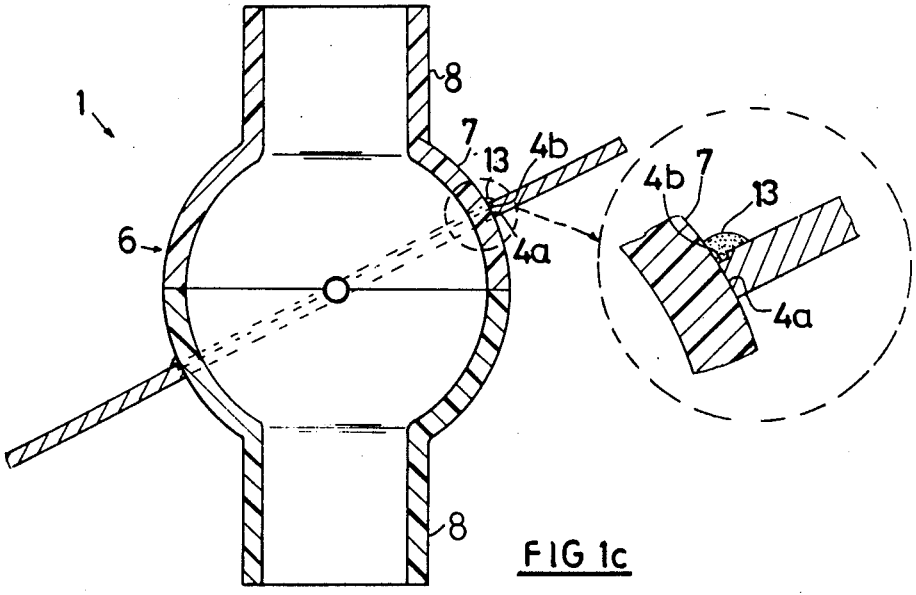
FIG. 1*c* is a section on line 1*c*—1*c* through the roof mounting of FIG. 1*b;*
Figure 1D:
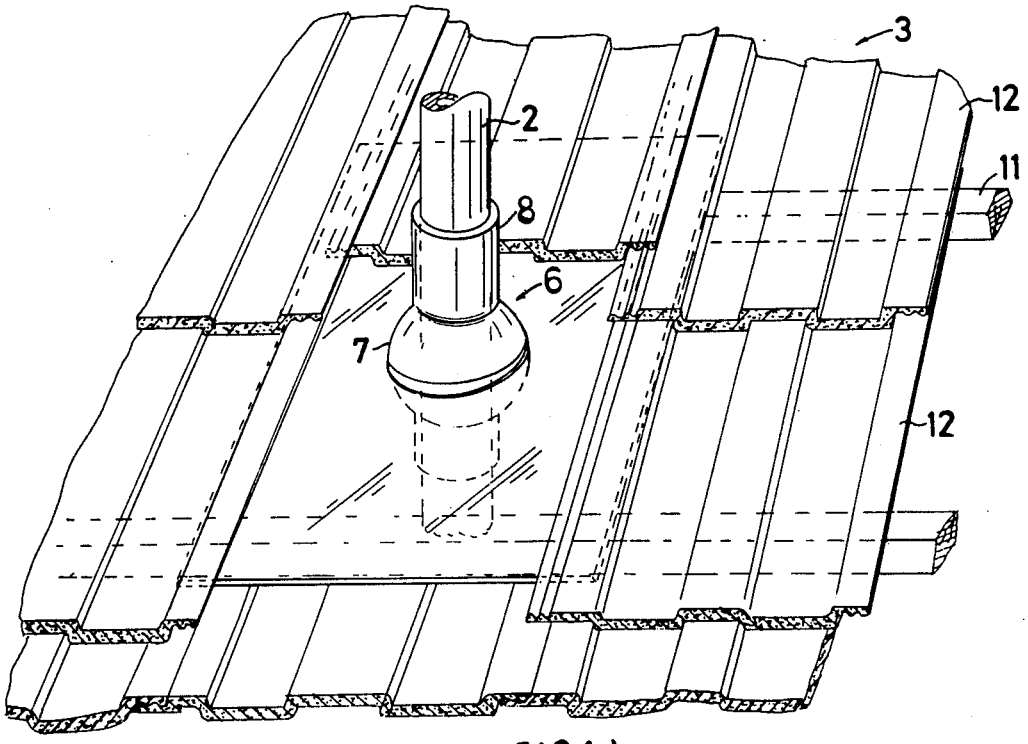
FIG. 1*d* is a perspective view of part of a tiled roof showing the roof mounting of FIGS. 1*a*–1*c* in an operative position.

In use, the roof mounting 1 is located in the roof 3 so that the rise pipe 2 passes through it, the stub pipes 8 of the connector 6 being so dimensioned that the rise pipe is a snug sliding fit through them. The plate 4 is thereupon placed on a purlin element 11 located immediately above the rise pipe 2, with the plate 4 located parallel to the pitch of the roof. In this position the connector 6 will have assumed an operative vertical position. Roof tiles 12 are now arranged in conventional manner about the plate 4 so that the tiles above the rise pipe 2 lie over the plate and those below the rise pipe lie under it (FIG. 1*d*).

The connection between the connector 6 and the plate 4 must be water tight to ensure effective water shedding by the roof fitting 1. Where one or other or both the connector 6 and plate 4 are moulded from a sufficiently resilient plastics material, the tight fit between these two components could ensure a sufficient water tight connection. In such a case the wall 4*a* of the plate 4 defining the circular hole 5 will have a concave curvature matching the curvature of the spherical formation 7 of the connector 6. However, sealing means in the form of a bonding agent 13 may be provided which is applied to the connection between the connector 6 and the plate 4. To increase the bond of the bonding agent 13 a recess 4*b* maybe provided in the wall 4*a* defining the hole 5 (FIG. 1*c*).

A bonding agent may likewise be applied to seal the fit between the rise pipe 2 and the upper stub pipe 8.

In an alternative arrangement, the stub pipes 8 above and below the spherical formation 7 may be smaller than the rise pipe 2 and the lower stub pipe 8 may be located in the upper end of the vent pipe, which may be made to terminate short of the roof. An extension pipe may, if required, be connected to the stub pipe 8 above the roof.

Figure 2A:
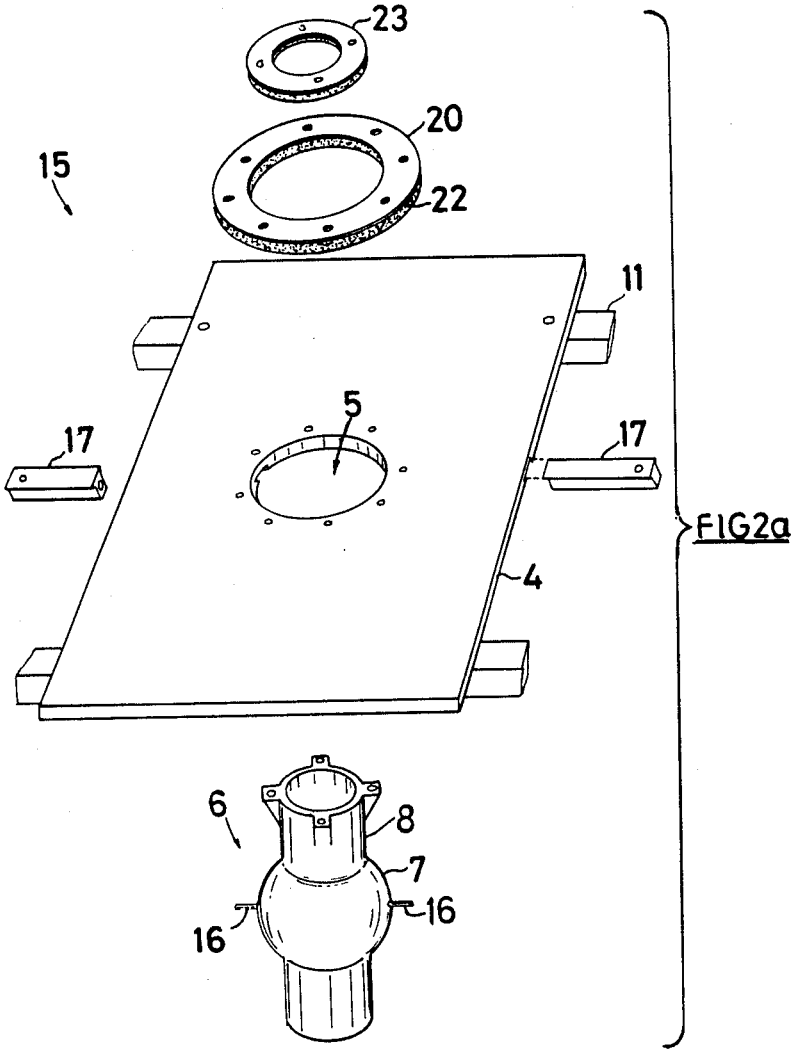
FIGS. 2*a*-2*c* are perspective views illustrating an alternative roof mounting constructed according to the invention.
Figure 2C:
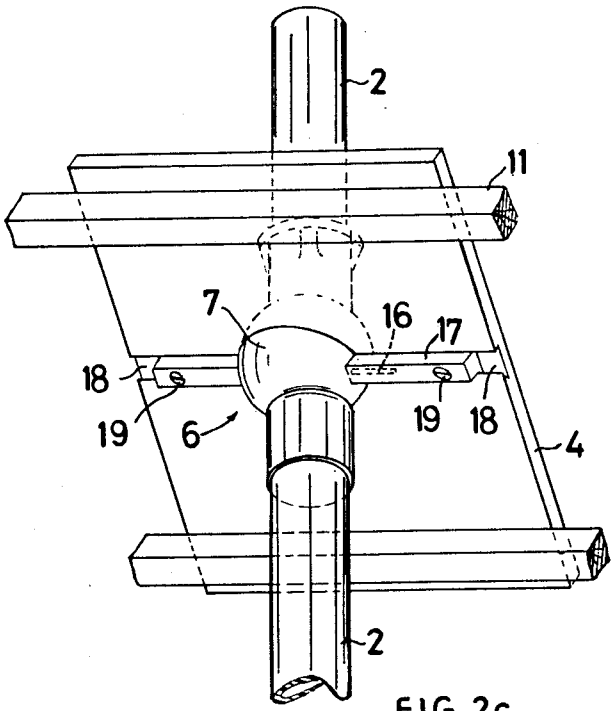
Figure 2B:
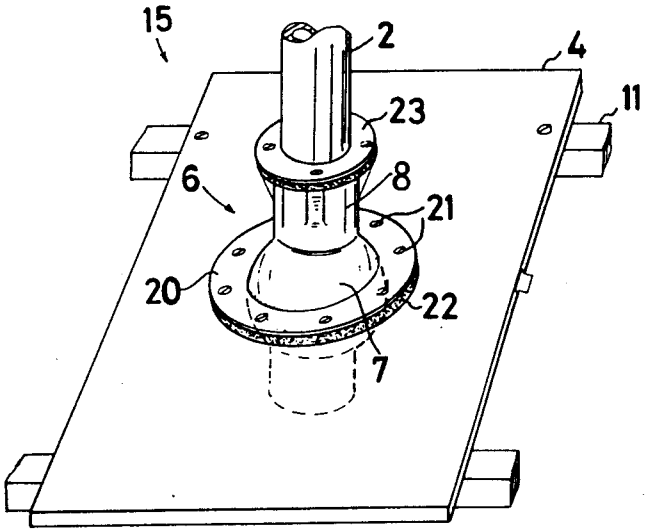
Figure 3A:
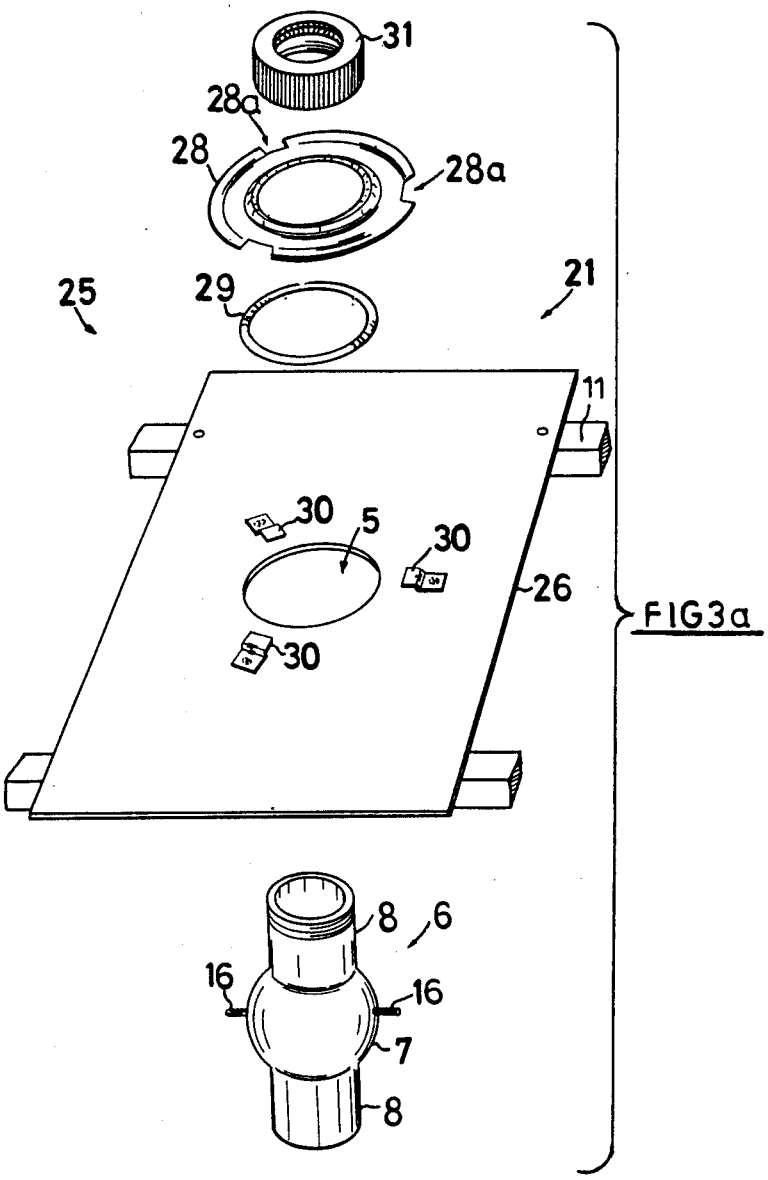
FIGS. 3*a*–3*c* are similar views illustrating a further alternative roof mounting constructed according to the invention.
Figures 3B, 3C, 3D:
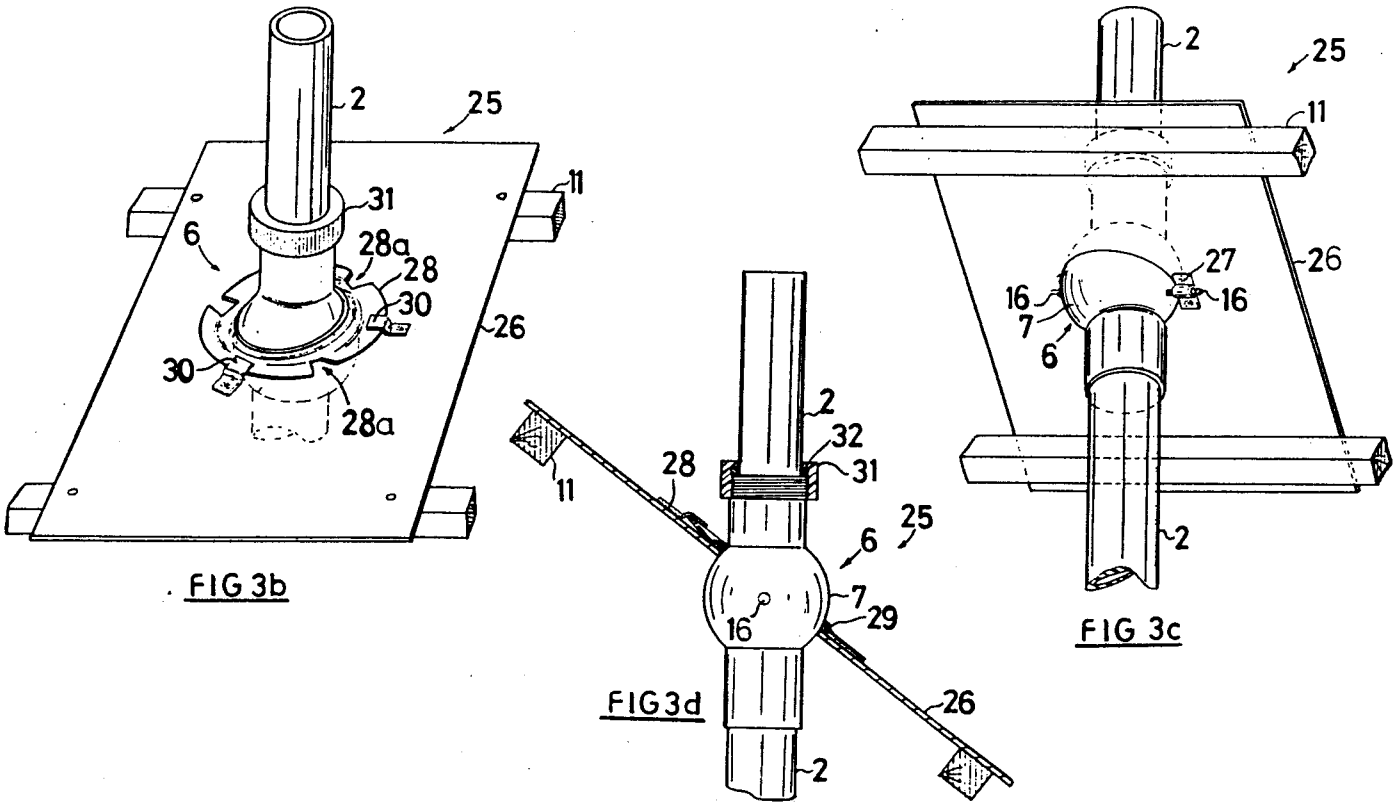
FIG. 3*d* is an elevational cross-section through the roof mounting of FIG. 3*b;*

With reference to FIGS. 2*a*–2*c*, a roof mounting 15 is shown in which the connector 6 is provided as a unitary construction and has a pair of opposed trunnions 16 extending from opposite sides of the spherical formation 7 of the connector. The trunnions 16 are carried for rotation in a pair of bearings 17 mounted on the underside of the plate 4. The bearings 17 are received in guide channels 18 to facilitate their installation and carry grub screws 19 which are used to secure them in position.

A collar 20 is provided which is secured to the upper side of the plate 4 to seal the connection between the spherical formation 7 of the connector 6 and the plate 4. The collar 20, which surrounds the hole 5 in the plate 4, may be secured thereto by means of screws, rivets or the like denoted by numeral 21 (FIG. 2*b*). A sealing member 22 is located between the collar 20 and the plate 4 to seal the connection between the spherical formation 7 of the connector 6 and the plate 4.

If required, a second collar 23, similar to the collar 20 described above, may be mounted on the upper end of the stub pipe 8 to seal the fit between the rise pipe 2 and the connector 6.

The roof mounting 25 shown in FIGS. 3*a*–3*d* differs in that it has a plate 26 which is made from sheet metal. The connector 6 may be moulded from plastics material. The trunnions 16 of the connector 6 are in this case received in bearings 27 which are spot welded to the plate 26.

A ring-like retaining member 28 is provided which is connected to the plate 26 and serves to hold a resilient O-ring 29 in position at the connection between the spherical formation 7 of the connector 6 and the plate 26. The O-ring 29 serves to seal this connection. In this embodiment of the invention the retaining member 28 is trapped beneath retaining formations 30 provided on the upper side of the plate 26 at spaced positions surrounding the hole 5.

The retaining formations 30 may be in the form of brackets spot welded to the plate 26. Recesses 28*a* corresponding to the retaining formations 30 are provided in the periphery of the retaining member 28 to enable it to be positioned under the retaining formations. The peripheral edge of the retaining member 28 is preferably sloped so that when it is twisted about its axis in one direction the edge acts on the retaining formations 30 to displace the retaining member 28 towards the plate 26, thereby serving to compress the sealing ring 29. If required, the peripheral edge of the retaining member 28 may be corrugated and a suitable ridge may be provided on each retaining formation 30 to improve the grip between the retaining member 28 and the retaining formations 30. The corrugations would also provide a better grip for a person to twist the retaining member about its axis.

If required, a sealing cap 31 may be provided to seal the fit between the upper stub pipe 8 and the rise pipe 2. In this embodiment of the invention the sealing cap 31 has an internal screw thread which engages a complementary thread on the upper stub pipe 8. The sealing cap 31 has a resilient O-ring 32 in its interior.

Figure 4A:
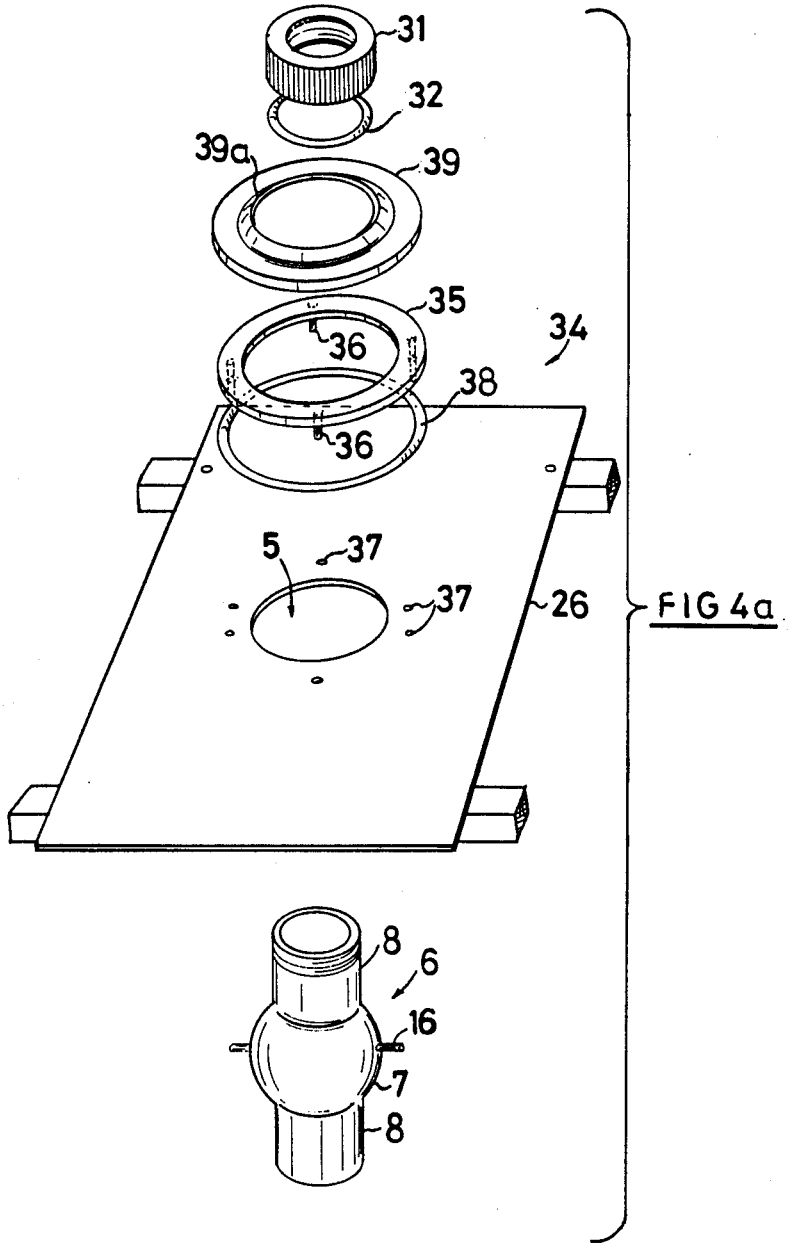
FIGS. 4*a*–4*c* are perspective views of a further alternative roof mounting constructed according to the invention.
Figures 4B, 4C, 5:
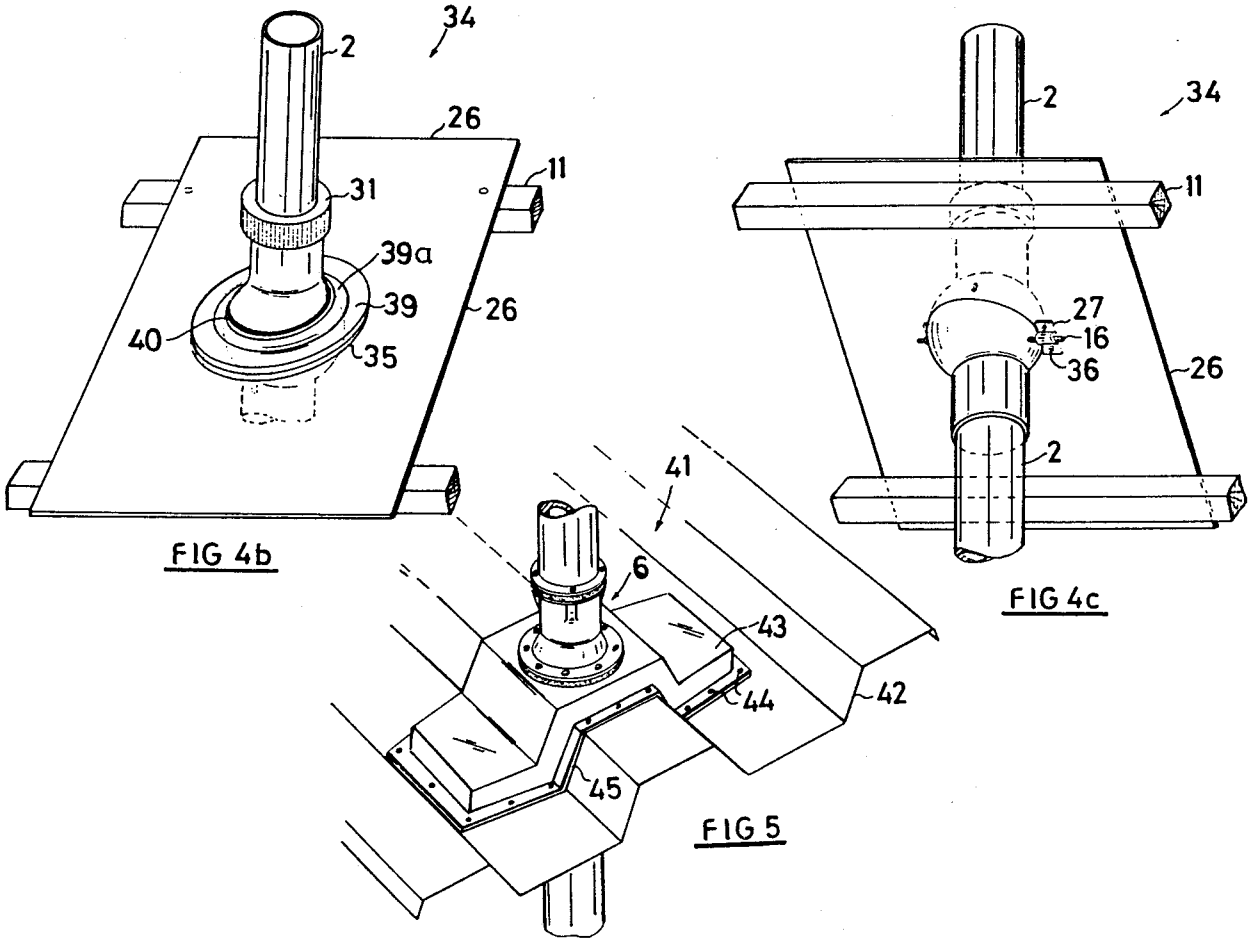
FIG. 5 is a perspective view illustrating a roof mounting according to the invention mounted on a profiled roof.

In the embodiment of the invention illustrated in FIGS. 4*a*–4*c* the plate 26 and the connector 6 of the roof mounting 34 are, as in the preceding embodiment, made of metal and plastics material respectively. In place of the retaining member 28 a base ring 35 made of plastics material is provided which has studs 36 projecting from it. The base ring 35 is secured to the plate 26 by pressing the studs 36 through corresponding holes 37 provided in the plate 26 at positions surrounding the hole 5. An O-ring 38 is furthermore provided between the base ring 35 and the plate 26 to create a seal between it and the plate on the periphery of the base ring 35. The studs 36 may also be used to hold the bearings 27 of the assembly in position (FIG. 4*c*). It is envisaged that the plate 26 with the base ring 35 and connector 6 will be provided in pre-assembled form.

A sealing ring 39 made of plastics material is provided which seats on the base ring 35. Along its inner periphery the sealing ring 39 has an arcuate lip 39*a* which seats on the spherical formation 7 of the connector 6. With this arrangement the sealing ring 39 may be secured to the base ring and to the spherical formation 7 by means of a bonding agent 40 to provide the required seal. The assembly therefore provides plastic on plastic contact between the base ring 35 and the sealing ring 39, making it possible to use a bonding agent successfully.

Finally, there is shown in FIG. 5 a roof mounting 41 which is mounted on a profiled roof 42. In this embodiment of the invention the roof mounting has a plate 43 which matches the profile of the roof cladding and is secured thereto by means of screws or bolts 44. A seal 45 is provided between the plate and the roof cladding. The connector 6 of the roof mounting may be mounted to the profiled plate 43 in the manner illustrated in FIG. 3c.

Other embodiments of the invention may be made differing in matters of detail from those described above and without departing from the scope of the invention as defined in the appended claims.

I claim:

1. A roof mounting for use in giving a rise pipe access through a roof comprising a plate having a circular hole therein, a connector embodying a spherical formation which fits closely in the circular hole in the plate, the connector having a passage therethrough and being shaped to receive the rise pipe, and, mounting means for mounting the connector to the plate in a manner permitting the connector to be pivotted relative to the plate, the roof mounting in an operative position being located with the plate parallel to the pitch of the roof and with the connector aligned with the rise pipe.

2. A roof mounting as claimed in claim 1 in which the mounting means comprise a pair of pivots carried on the plate and projecting in the plane of the plate into the circular hole, the connector being provided in two halves split across the middle of the spherical formation, the two halves of the connector having notches for accommodating the pivots and being secured together with the pivots located in the notches.

3. A roof mounting as claimed in claim 1 in which the mounting means comprise a pair of trunnions carried on the spherical formation and located for rotation in a pair of bearings mounted on the underside of the plate.

4. A roof mounting as claimed in claim 1 including sealing means for sealing the connection between the spherical formation and the plate.

5. A roof mounting as claimed in claim 4 in which the sealing means comprise a bonding agent applied to the connection.

6. A roof mounting as claimed in claim 4 in which the sealing means comprise a collar adapted to be secured to the plate to surround the circular hole and a sealing member located between the collar and the plate.

7. A roof mounting as claimed in claim 4 in which the sealing means comprise a ring-like retaining member adapted to be connected to the plate and a resilient sealing member adapted to be held by the retaining member in sealing engagement at the connection between the spherical formation and the plate, the arrangement being such that the retaining member may be twisted about its axis to force it towards the plate, thereby to compress the resilient sealing member.

8. A roof mounting as claimed in claim 7 in which the retaining member is trapped beneath formations on the plate and the peripheral edge of the retaining member is sloped so that when it is twisted in one direction the edge acts on the formations to displace the retaining member towards the plate.

9. A roof mounting as claimed in claim 4 in which the sealing means comprise a base ring secured to the plate, a resilient sealing ring located between the base ring and the plate and a sealing member bonded to the base ring.

10. A roof mounting as claimed in claim 1 in which the connector includes a pair of stub pipes integral with the spherical formation and extending upwardly and downwardly from opposite ends thereof.

* * * * *